US012559848B2

(12) United States Patent
Li

(10) Patent No.: US 12,559,848 B2
(45) Date of Patent: Feb. 24, 2026

(54) LIGHTWEIGHT ELECTROLYZER WITH A PLUG-IN MODULE

(71) Applicant: Haiming Li, Quincy, MA (US)

(72) Inventor: Haiming Li, Quincy, MA (US)

( * ) Notice: Subject to any disclaimer, the term of this patent is extended or adjusted under 35 U.S.C. 154(b) by 419 days.

(21) Appl. No.: 18/071,427

(22) Filed: Nov. 29, 2022

(65) Prior Publication Data

US 2024/0175145 A1 May 30, 2024

(51) Int. Cl.

| | |
|---|---|
| ***C25B 9/00*** | (2021.01) |
| ***C25B 1/02*** | (2006.01) |
| ***C25B 9/17*** | (2021.01) |
| ***C25B 15/08*** | (2006.01) |

(52) U.S. Cl.
CPC ..... *C25B 9/17* (2021.01); *C25B 1/02* (2013.01); *C25B 15/08* (2013.01)

(58) Field of Classification Search
CPC ..... C25B 9/17; C25B 1/02; C25B 15/08
See application file for complete search history.

(56) References Cited

U.S. PATENT DOCUMENTS

| | | | | |
|---|---|---|---|---|
| 2015/0114831 | A1* | 4/2015 | Kawasaki | C25B 9/23 204/252 |
| 2016/0122885 | A1* | 5/2016 | Ishikawa | C25B 9/05 204/257 |
| 2018/0099881 | A1* | 4/2018 | Fryda | C02F 1/4672 |
| 2019/0252708 | A1* | 8/2019 | Sone | H01M 8/186 |

* cited by examiner

*Primary Examiner* — Zulmariam Mendez

(57) ABSTRACT

The disclosure relates to the technical field of electrolytic cells, in particular to a lightweight electrolyzer with a plug-in module comprising two end plates. An electrolysis chamber is arranged between the end plates, the electrolysis chamber includes an anode plate and a cathode plate, and two tie rods run through the two end plates, respectively, the electrolysis chamber is engaged with a chamber fixing frame engaged with a first splint and a second splint, both the outer sides of the first splint and the second splint are connected with fixing blocks and provided with grooves. The outside of the bottom of one of the end plates is fixedly connected with a slide rail, so that the fixing frame of the cell, the first splint, the second splint, and the guidance of the slide rail can be used to make the installation and disassembly more flexible.

9 Claims, 10 Drawing Sheets

LIGHTWEIGHT ELECTROLYZER WITH A PLUG-IN MODULE

TECHNICAL FIELD

The disclosure relates to the technical field of electrolytic cells, in particular to a lightweight electrolyzer with a plug-in module

BACKGROUND AND PRIOR ART

As the cleanest and most efficient energy in the 21st century, hydrogen has become the most sought-after energy source. How to efficiently produce hydrogen has also become a key research technology. Hydrogen production by alkaline water electrolysis is a mature hydrogen production technology. The most critical component in hydrogen production technology is the electrolyzer, and how to optimize the cell structure of the electrolyzer, which provides direction for the expansion of the capacity of the electrolyzer, has become one of the key technologies.

Since alkaline water-electrolysis hydrogen production technology has formed a large-scale commercialization model at home and abroad, once the electrolyzer is assembled, the number of electrolytic cells cannot be changed. Once faced with insufficient production capacity, the only option is to purchase more equipment to solve the problem, which significantly increases the cost to the user. Therefore, a lightweight electrolyzer with a plug-in module is proposed to solve the above issues.

SUMMARY

The purpose of the present invention is to provide a lightweight electrolytic cell with a plug-in module to solve the problem that once the electrolytic cell is assembled, the number of electrolytic cells cannot be changed.

In order to achieve the above object, the present invention provides the following technical proposals:

A lightweight electrolytic cell with a plug-in module, comprising an end plate, a liquid inlet pipe is arranged on the end plate, an electrolysis cell is placed between the end plates, and the electrolysis cell includes an anode plate and a cathode plate; the There are two end plates, and there are pull rods running through the two end plates. Both ends of the pull rods are provided with threaded parts. The outside of the electrolysis cell is engaged with a cell-fixing frame. A first splint and a second splint are involved on the outside, and fixed blocks are fixedly connected to the outside of the first splint and the second splint, and bolts connect the designated blocks. The first splint and the second splint are all provided with grooves, and a slide rail is fixedly connected to the outside of the bottom of one of the end plates, and the other end of the slide rail is slidably connected to the other end plate.

Preferably: the inside of the electrolysis cell is provided with a thin gasket, a cylinder frame, a thin gasket, a cathode plate, a thick gasket, a diaphragm, a thin gasket, a cylinder frame, a thin gasket, and an anode plate in sequence, and the diaphragm There is an electrolyte through a hole on the inner side, wherein the inner sides of the anode plate and the cathode plate are respectively provided with hydrogen through holes and oxygen through holes, and both the anode plate and the cathode plate are fixedly connected with power terminals.

Preferably: a nut is screwed to the outer side of the threaded part of the pull rod, a buffer spring is sleeved on the outer side of the threaded portion of the pull rod, and the buffer spring is sleeved between the nut and the end plate.

Preferably: the pull rods, buffer springs, and nuts are arranged in an even number, and the pull rods, buffer springs, and nuts are arranged axially symmetrically to the central connecting line of the two end plates.

Preferably: the nut is divided into an upper half and a lower half, the upper half and the lower half of the nut are rotationally connected by a rotating shaft, and a hexagonal fixing ring is provided outside the nut, wherein the inner space of the fixed hexagonal ring matches the shape of the nut.

Preferably: both the first splint and the second splint are polygonal, the hexagonal fixing ring is made of strongly magnetic material, the thickness of the hexagonal fixing ring is one-fifth of the nut thickness, the cylinder frame of the cathode plate is communicated with one end of the hydrogen gas branch pipe, the other end of the hydrogen branch pipe is connected with the main hydrogen pipe, one end of the oxygen branch pipe is communicated with the cylinder frame of the anode plate, the other end of the oxygen branch pipe is connected to the central oxygen pipe.

Preferably: the inner side of the power end is provided with a limiting slot, one end of the compression spring is fixedly connected to the inner side of the limit slot, the other end of the compression spring is fixedly attached to a slide block, the outer side of the slider is fixedly connected with a block, the outer side of the clamping block is slidably coupled with the power supply Preferably: the end of the clamping block that is biased to the fixing groove of the power supply end is set on an arc surface, the length of the clamping block extending into the fixing groove of the power supply end is 1.2 times the diameter of the clamping block.

Preferably: the inner side of the slider is embedded with balls, the outer side of the ball is slidingly connected with the limit groove, and the balls are evenly distributed inside the slider.

Compared with the prior art, the beneficial effect of the present invention is:

1. In the present invention, the fixing of the small chamber fixing frame, the first splint, and the second splint can be utilized through the electrolysis cell, the pull rod, the cell fixing frame, the first splint, the second splint, the fixing block, and the slide rail. And the slide rail guide can make the installation and disassembly of the electrolytic cells more flexible and solve the problem that once the electrolytic cells are assembled, the number of electrolytic cells cannot be changed. Once faced with insufficient production capacity, users can only buy more to solve the problem, which significantly increases the cost of the user.

2. In the present invention, the installation and disassembly of the overall device can be more efficient by setting the nut and hexagonal fixing ring. The nut with a rotating structure can be used to make the installation and disassembly of the overall device more efficient, avoid the problem that the nut needs to be screwed for a long distance in the process of installation and disassembly, improve the efficiency of the installation and disassembly of the overall device, and improve the functional performance of the overall device.

3. In the invention, the clamping and disconnecting of the clamping block and the power supply screw can be made using the limiting slot, the compression spring, the slider, and the clamping block, so that the power supply end is more convenient and efficient. The problem of the power supply screw falling off during the connecting of the power supply can be avoided, and the connecting efficiency of the whole device is improved.

BRIEF DESCRIPTION OF THE FIGURES

Brief Description of the Drawings

Figure 1:
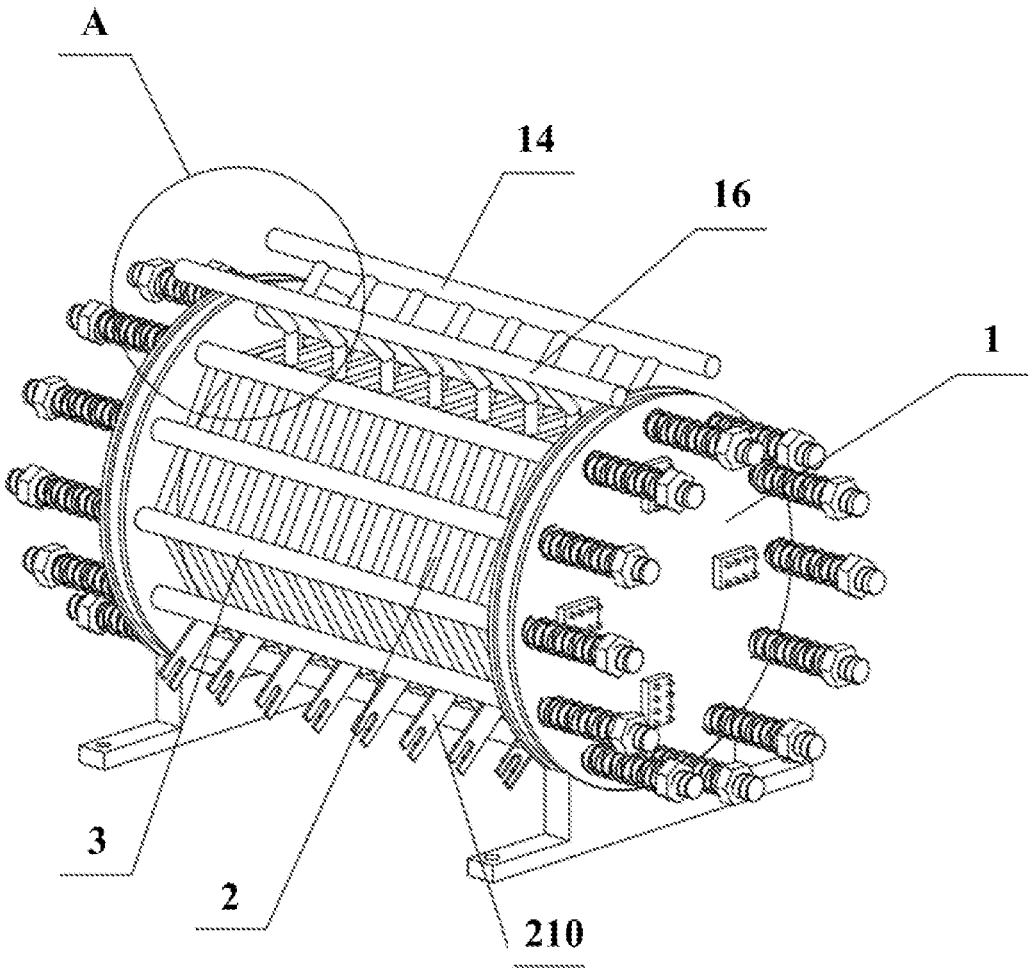
Figure 2:
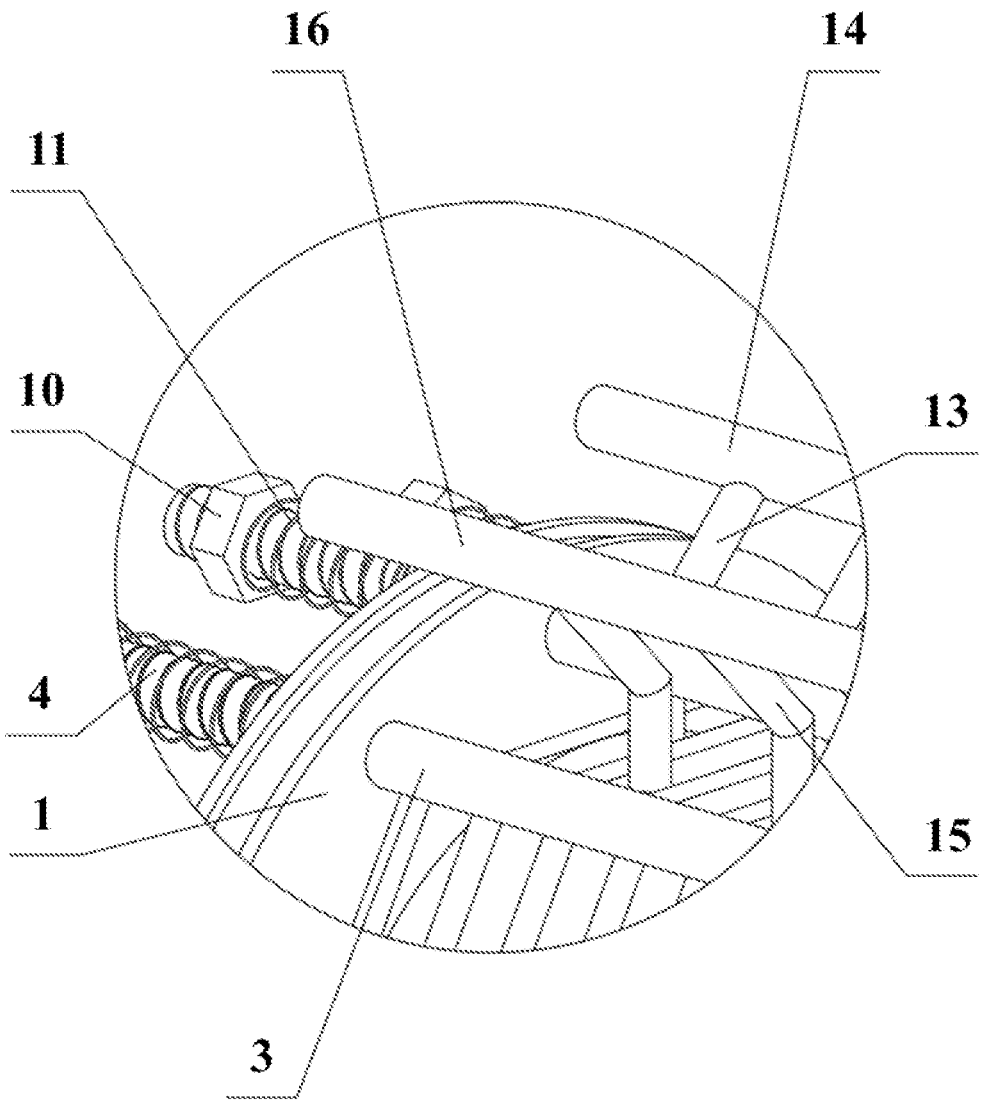
Figure 3:
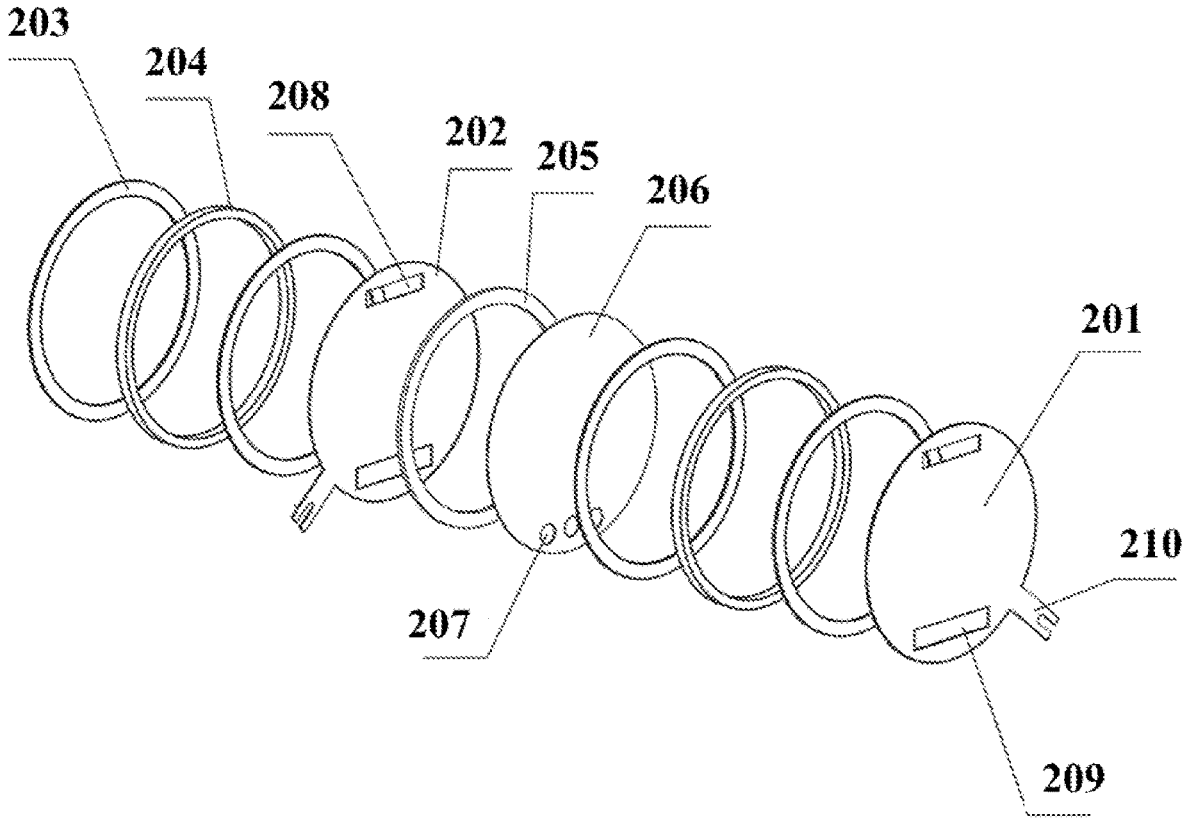
Figure 4:
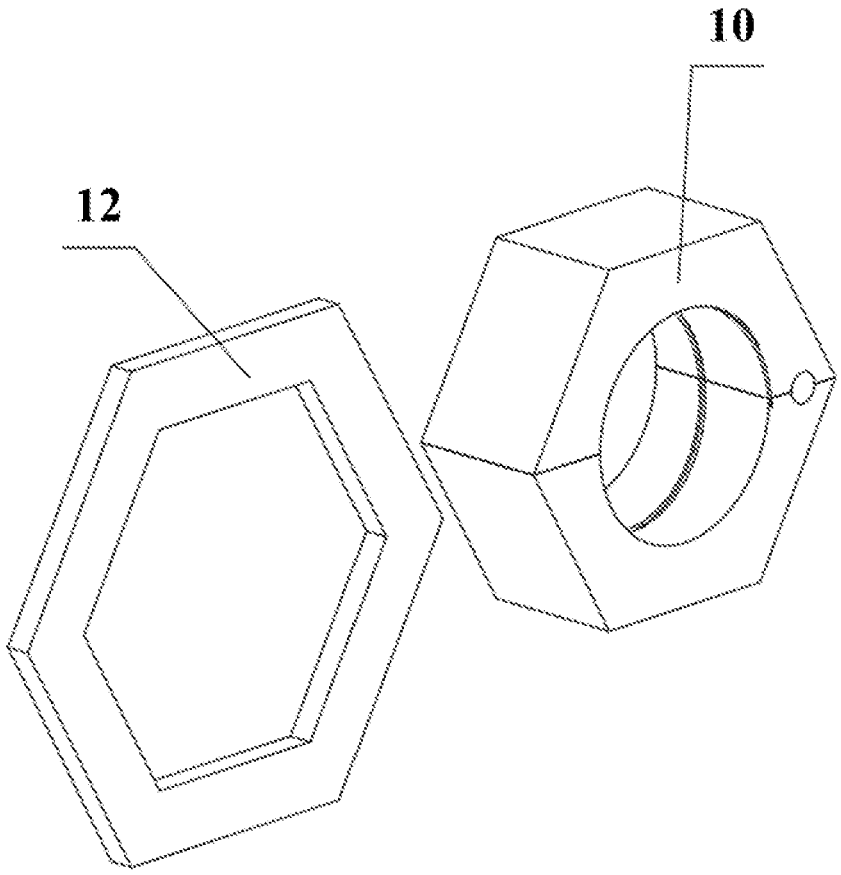
Figure 5:
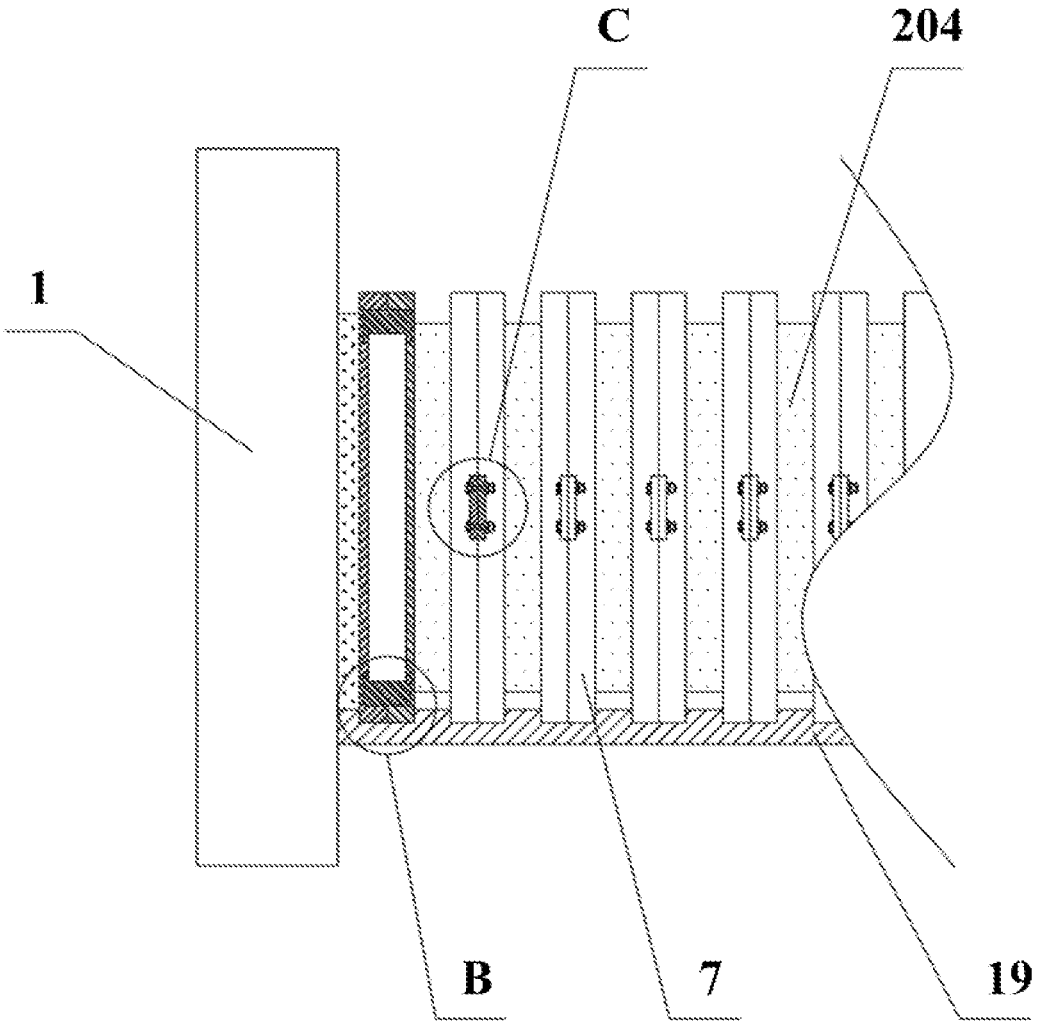
Figure 6:
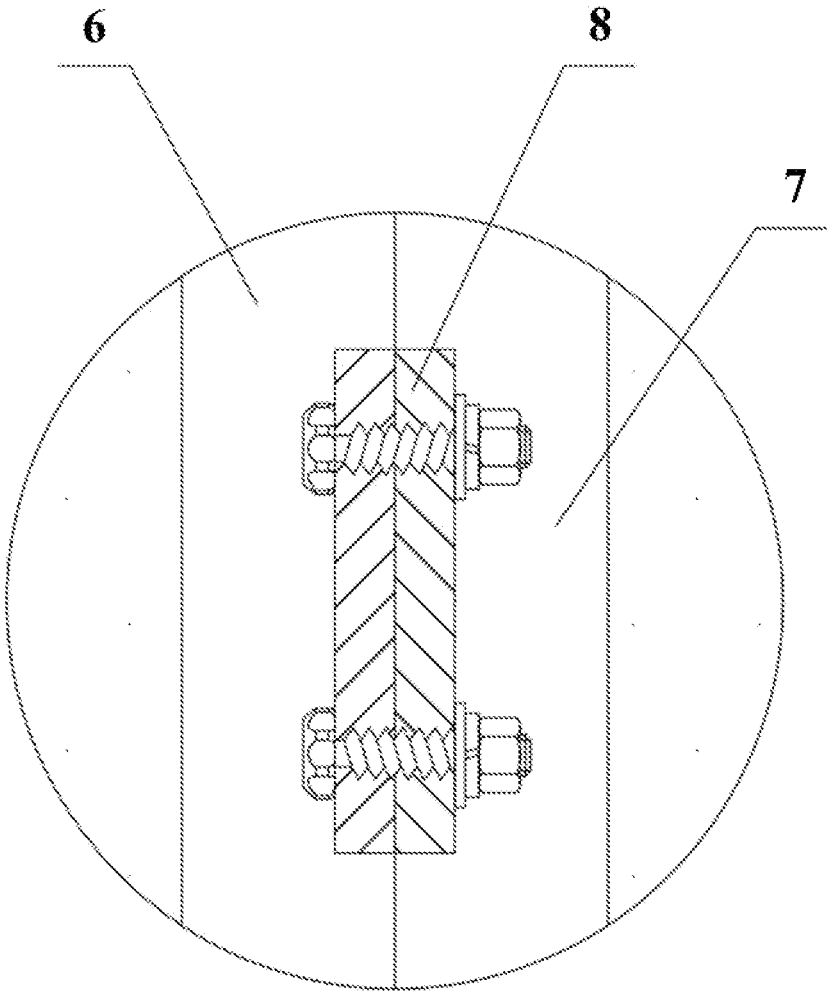
Figure 7:
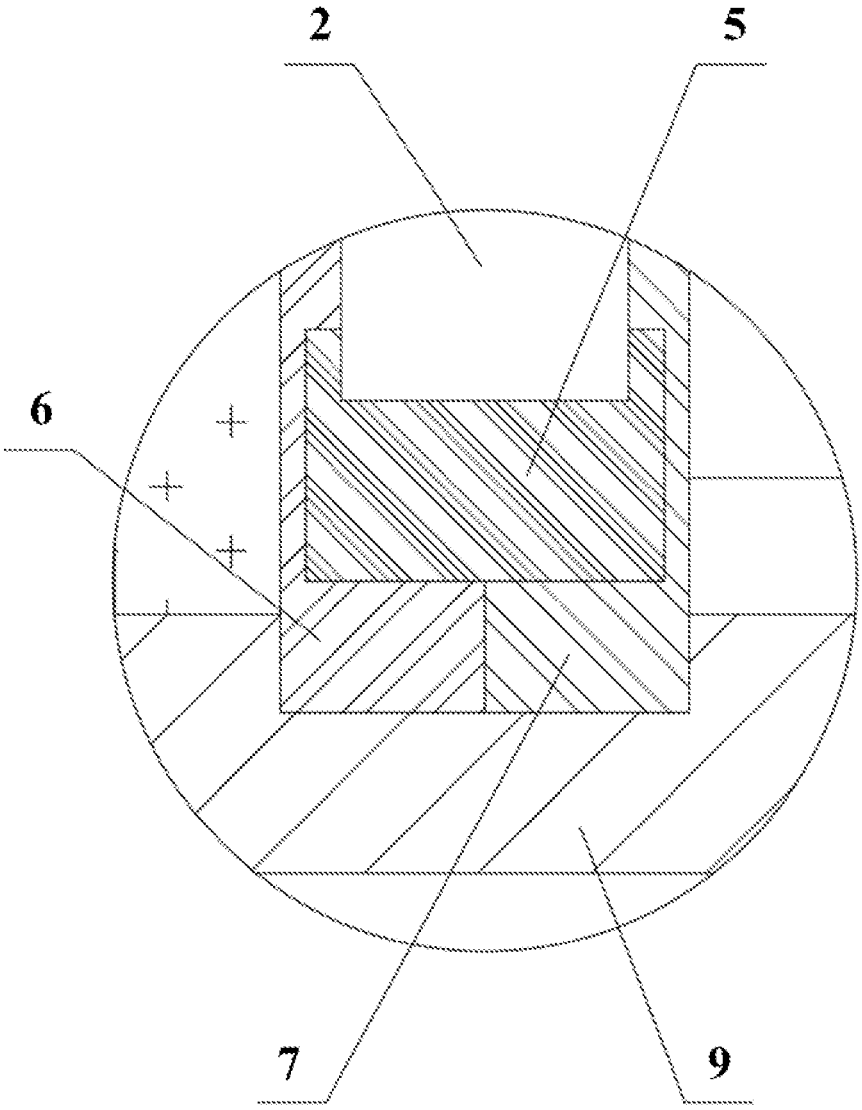
Figure 8:
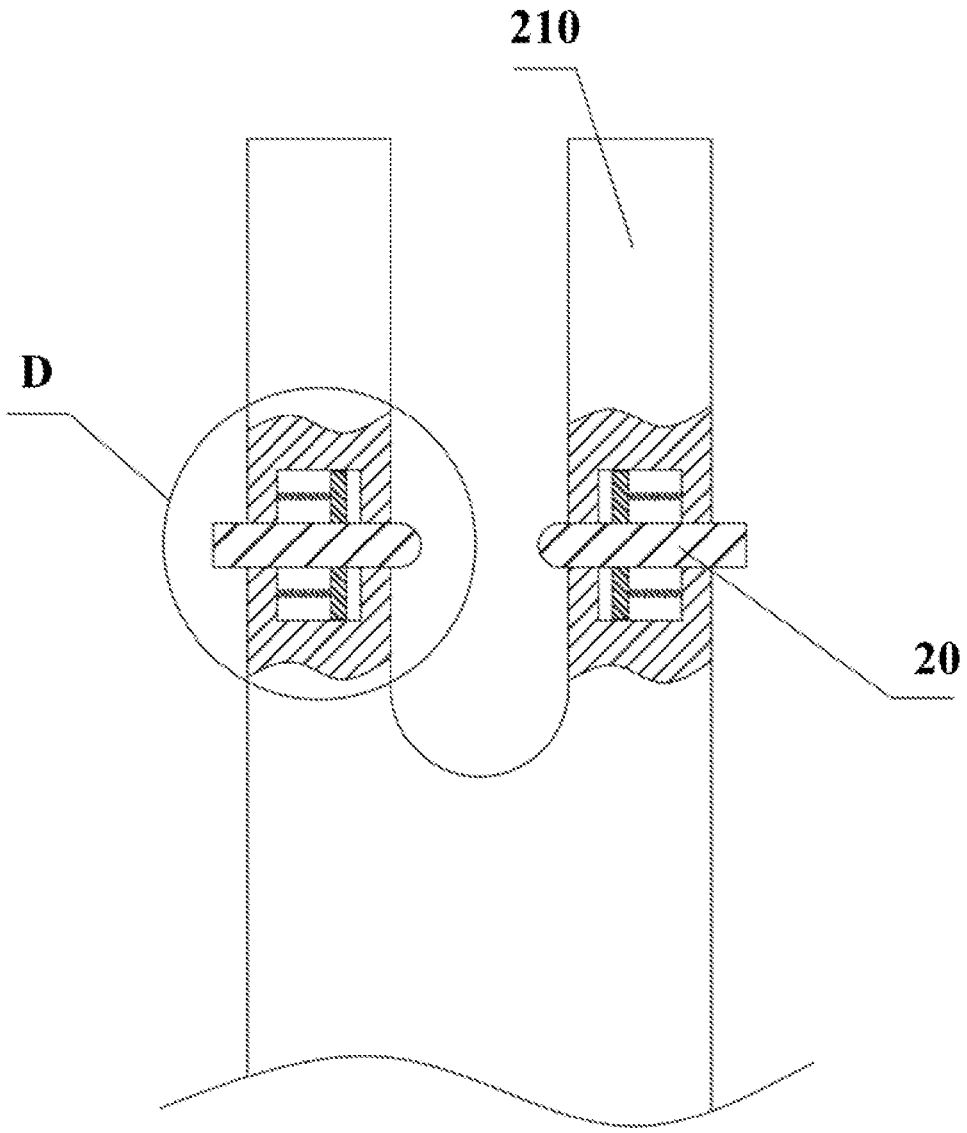
Figure 9:
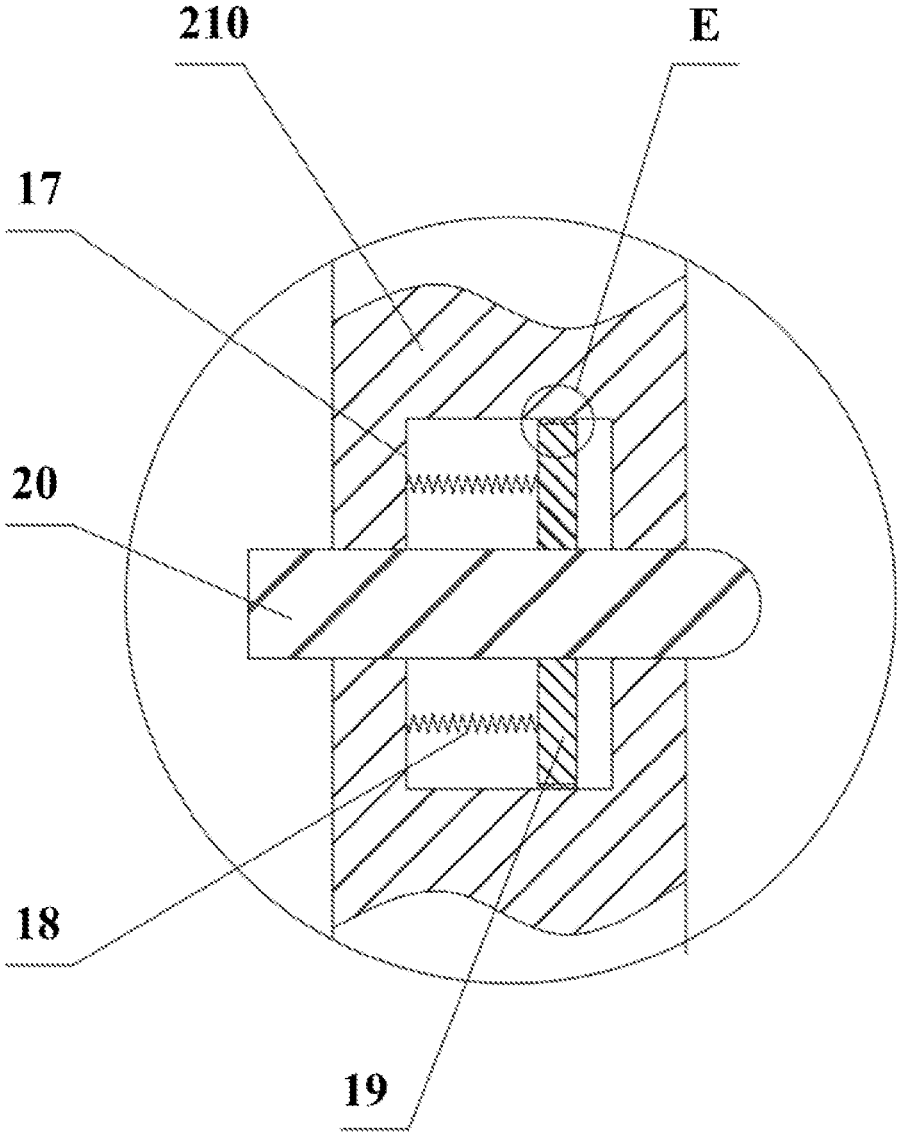
Figure 10:
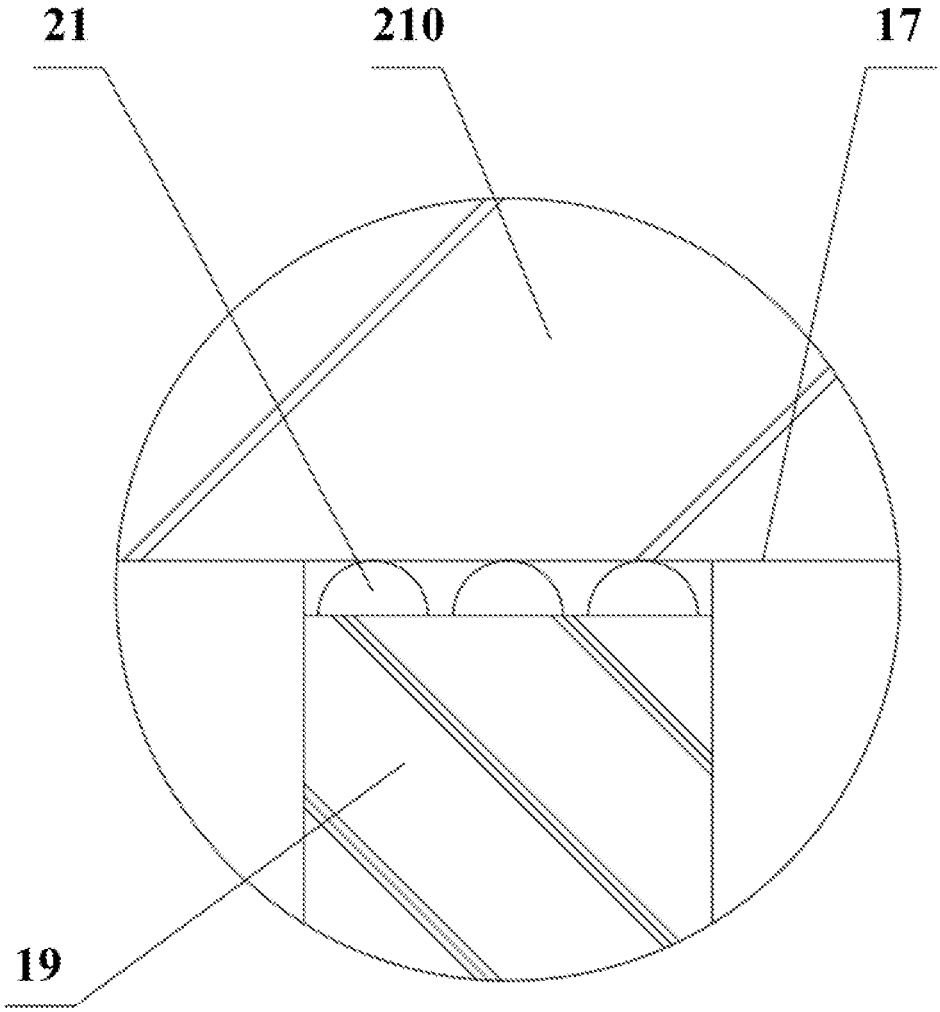

FIG. 1 is the overall structure schematic diagram;

FIG. 2 is a structural schematic diagram of place A of FIG. 1;

FIG. 3 is a schematic diagram of the explosion structure of the electrolysis chamber;

FIG. 4 is the structural representation of the nut and fixed hexagonal ring;

FIG. 5 is a schematic diagram of the installation structure of the slide rail;

FIG. 6 is a schematic diagram of the structure at B of FIG. 5;

FIG. 7 is a schematic structural diagram at C of FIG. 5;

FIG. 8 is a schematic diagram of the installation structure of the block;

FIG. 9 is a schematic diagram of the structure at D of FIG. 8;

FIG. 10 is a schematic diagram of the structure at E in FIG. 9;

In the figure: 1—end plate, 2—electrolytic chamber, 201—anode plate, 202—cathode plate, 203—thin gasket, 204—cylinder frame, 205—thick gasket, 206—diaphragm, 207—electrolyte through-hole, 208—Hydrogen through-hole, 209—Oxygen through-hole, 210—Power supply, 3—Tie rod, 4—Threaded part, 5—Fixed structure, 6—First splint, 7—Second splint, 8—Fixed block, 9—Slide rail, 10—Nut, 11—Buffer spring, 12—Hexagonal fixed ring, 13—Hydrogen branch pipe, 14—Hydrogen main pipe, 15—Oxygen branch pipe, 16—Oxygen main pipe, 17—Limiting groove, 18—Compression spring, 19—slider, 20—block, 21—ball.

DETAILED DESCRIPTION OF EXAMPLE EMBODIMENTS

The following will clearly and completely describe the technical solutions in the embodiments of the present invention regarding the accompanying drawings in the embodiments of the present invention. The described embodiments are only some of the embodiments of the present invention. Based on the embodiments of the present invention, all other embodiments obtained by persons of ordinary skill in the art without making creative efforts belong to the protection scope of the present invention.

Please refer to FIGS. 1-10. The invention provides a technical solution:

The utility model relates to a lightweight electrolyzer with a plug-in module, including end plate 1; end plate 1 is provided with a liquid inlet pipe, the end plate 1 is provided with an electrolysis chamber 2, the end plate 2 includes an anode plate 201 and a cathode plate 202, the end plate 1 has two, both end plates 1 are threaded through the rod 3, both ends of the rod 3 are provided with a thread section 4, the end plate 1 is provided with an anode plate 201 and a cathode plate 202. The outer side of the electrolytic chamber 2 is clamped with the small chamber fixed frame 5, the outer side of the small chamber fixed frame 5 is clamped with the first splint 6 and the second splint 7, the outer side of the first splint 6 and the second splint 7 are fixed connected with the fixed block 8, the fixed block 8 is connected by bolts, the bottom of the first splint 6 and the second splint 7 are provided with a groove, The bottom outside of one end plate 1 is fixed with slide rail 9, and the other end of slide rail 9 is sliding connected with the other end plate 1, so that the fixed frame 5 of the chamber, the fixation of the first splint 6 and the second splint 7, and the guidance of slide rail 9 can be used to make the installation and disassembly of the electrolysis chamber 2 more flexible, and solve the problem that once the electrolyzer is assembled, The number of electrolysis chamber 2 cannot be changed. Once facing the situation of insufficient production capacity, we can only choose to purchase more to solve the problem, which greatly increases the cost of the user end. The inner side of the electrolytic chamber 2 is arranged with a thin sealing pad 203, cylinder frame 204, thin sealing pad 203, cathode plate 202, thick sealing pad 205, diaphragm 206, thin sealing pad 203, cylinder frame 204, thin sealing pad 203 and anode plate 201, and the inner side of diaphragm 206 is provided with electrolyte through hole 207. A hydrogen through-hole 208 and an oxygen through-hole 209 are provided inside the anode plate 201 and cathode plate 202, respectively. The power supply end 210 is fixed on both the anode plate 201 and cathode plate 202, which can make the structure of the whole device more reasonable. The outer screw part 4 of tie rod 3 is connected with nut 10. The outer sleeve of thread part 4 of tie rod 3 is provided with buffer spring 11, which is connected between nut 10 and end plate 1 so the overall device can work more smoothly. Tie rod 3, buffer spring 11, and nut 10 are all set in even numbers, and tie rod 3, buffer spring 11 and nut 10 are all set in axial symmetry with the center connecting line of two end plates 1. This can make the force of the overall device more balanced; nut 10 is divided into the upper half. The lower half, the upper half of nut 10, and the lower half of nut 10 are connected by the rotating shaft, the outer part of nut 10 is provided with a hexagonal fixing ring 12, and the inner space of hexagonal fixing ring 12 matches the shape of nut 10, In this way, the nut 10 of the rotating structure can be used to make the installation and disassembly of the whole device more efficient, avoiding the problem that nut 10 needs to be rotated for a longer distance in the process of installation and disassembly, improving the efficiency of the installation and disassembly of the whole device, and improving the functional performance of the whole device. The first splint 6 and the second splint 7 are polygonal Settings. Hexagonal fixing ring 12 is made of strongly magnetic material, and the thickness of hexagonal fixing ring 12 is one-fifth of nut 10. Cylinder frame 204 of cathode plate 202 is connected with one end of hydrogen branch tube 13, and the other end of hydrogen branch tube 13 is connected with hydrogen main pipe 14. Cylinder frame 204 of anode plate 201 is connected with one end of oxygen branch tube 15. The other end of the oxygen branch pipe 15 is connected with the oxygen chief 16 so that the hydrogen and oxygen can be better transported and utilized; the power end 210 is set on the inside of the limited slot 17, the limit slot 17 is fixed with one end of the compression spring 18, the other end of the compression spring 18 is fixed with the slider 19, the outside of the slider 19 is fixed with the card block 20, The outside of the card block 20 is sliding connected with the power supply end 210, which can make use of the card block 20 and the power supply screw clamping and disc clamping, making the power supply end 210 more convenient and efficient, avoiding the problem of the power supply screw falling off in the process of connecting the power supply end 210, improving the power connection efficiency of the whole device. One end of the card block 20 biased to the power end 210 fixed slot is set as a cambered surface. The length of the card block 20 inserted into the fixed slot of the power end 210 is 1.2 times the diameter of the card block 20, which can make the power supply screw clamping more reasonable. The inside of slide block 19 is embedded with ball 21, and the outside of ball 21 is sliding and connected with the limit slot 17. Ball 21 is evenly distributed on the inside of slider 19, which can make slider 20 slides more smoothly.

Working process: all parts are connected to an external power supply when electricity is needed, and a controller controls the device. When electrolytic cell 2 needs to be assembled, the thin gasket 203, cathode plate 202, thick gasket 205, diaphragm 206, thin gasket 203, thin gasket 203, and anode plate 201 are assembled in turn.

Then clamp the small chamber fixed frame 5 on the outside of the assembled electrolytic chamber 2, then attach the first splint 6 and the second splint 7 on the outside of the small chamber fixed frame 5, and connect the two designated blocks 8 together with the connection bolt, repeat the above operation to assemble the remaining electrolytic chamber 2, and then install the components of the electrolytic chamber 2 except cylinder frame 204 together through the slide rail 9.

Then use tie rod 3 to clamp all the electrolyzer chamber 2 between the two end plates 1, and then install the buffer spring 11, turn and open the nut 10, and then install the nut 10 near the end of the buffer spring 11, and then clamp the hexagonal fixing ring 12 on the outside of the nut 10, and then use the tool to tighten the nut 10.

Then install hydrogen branch pipe 13, hydrogen main pipe 14, oxygen branch pipe 15, and oxygen main pipe 16, connect the liquid inlet pipe, and finally push the power supply screw into the fixed groove of the power supply end 210. Due to the compression and contraction of clamp 20, when the power supply screw is stuck in the fixed groove of clamp 20, clamp 20 will rebound and jam the power supply screw under the elastic potential energy of the compression spring 18.

Then the power clamp nut is used to fix the power supply end 210 and the power supply screw, and finally, the power supply screw is energized. The electrolyte flows into the electrolytic chamber 2 through the liquid inlet pipe and the electrolyte through hole 207. The hydrogen will be discharged and collected through the hydrogen branch pipe 13 and hydrogen main pipe 14 sets on the cylinder frame 204 of the cathode plate 202. The oxygen will be discharged and collected through the oxygen branch pipe 15, and oxygen main pipe 16 arranged on cylinder frame 204 of the anode plate 201

What is claimed is:

1. A lightweight electrolytic cell with a pluggable module, which comprises an end plate on which a liquid inlet pipe is provided, and its characteristics are as follows: the end plate is arranged between the electrolytic chamber; the electrolytic chamber comprises an anode plate and a cathode plate; the end plate has two end plates, the two end plates threaded through a rod, and both ends of the rod are provided with a thread section, the outer side of the electrolytic chamber is clamped with a small chamber fixed frame, the outer side of the small chamber fixed frame is clamped with a first splint and a second splint, the outer side of the first splint and a second splint are fixedly connected with a fixed block, the fixed block is connected by bolts, the bottom of the first splint and the second splint is provided with a groove, one of the bottoms of the outer side of the end plate is fixedly connected with a slide rail, and the other end of the slide rail is slidably connected to the other end plate.

2. The electrolytic cell according to claim 1, is characterized by: the inner side of the electrolytic chamber being arranged with a thin gasket, cylinder frame, thin gasket, cathode plate, thick gasket, diaphragm, thin gasket, cylinder frame, thin gasket, and anode plate, the inner side of the diaphragm is provided with an electrolyte through the hole, the anode plate and the cathode plate are respectively provided with hydrogen through hole and oxygen through the hole, the anode plate and cathode plate are fixable connected with a power supply end.

3. The electrolytic cell according to claim 1, is characterized in that: the outer side of the threaded part of the tie rod is screw-connected with a nut, and the outer side of the threaded portion of the tie rod is sleeved with a buffer spring, the buffer spring is sleeved between the nut and the end plate.

4. The electrolytic cell according to claim 1, is characterized in that: the pull rods, buffer springs, and nuts are all set in even numbers, and the pull rods, buffer springs, and nuts are all connected by two ends, the central connection line of the board is arranged in an axisymmetric manner.

5. The electrolytic cell according to claim 1, is characterized in that: the nut is divided into an upper half and a lower half, and the upper half and the lower half of the nut pass through the rotating shaft are rotatably connected, and a hexagonal fixing ring is arranged on the outside of the nut, and the inner space of the hexagonal fixing ring matches the shape of the nut.

6. The electrolytic cell according to claim 1 is characterized in that: the first splint and the second splint are polygonal, and the hexagonal fixing ring is made of strongly magnetic material; the thickness of the hexagonal fixed ring is one-fifth of the thickness of the nut, the cylinder frame of the cathode plate is connected with one end of the hydrogen branch pipe, and the other end of the hydrogen branch pipe is connected with the hydrogen main pipe, one end of the oxygen branch pipe is communicated with the cylinder frame of the anode plate, and the other end of the oxygen branch pipe is communicated with the oxygen main pipe.

7. The electrolytic cell according to claim 1, is characterized in that: the inner side of the power supply end is provided with a limiting slot, and the inner side of the limiting slot, one end of the compression spring is fixedly connected, the other end of the compression spring is fixedly connected with the slider, and the outer side of the slider is fixedly connected with the clamping block, the outer side of the clamping block is slidably connected with the power terminal.

8. The electrolytic cell according to claim 1, is charactered in that: one end of the card block biased towards the fixed groove of the power supply end is arranged as a camber, and the length of the card block inserted into the fixed groove of the power supply end is 1.2 times of the diameter of the card block.

9. The electrolytic cell according to claim 1, is characterized in that: the inner side of the slider is inlaid with balls, the outer side of the balls is slidably connected with the limit groove, and the balls are uniformly distributed on the inner side of the slider.

* * * * *